US007451945B2

(12) United States Patent
Wollenhaupt et al.

(10) Patent No.: US 7,451,945 B2
(45) Date of Patent: Nov. 18, 2008

(54) SINGLE-SIDED, DOUBLE HINGED FRAME FOR ROLLER PRESSES

(75) Inventors: Gereon Wollenhaupt, Bochum (DE); Kai-Uwe Habermann, Muhlheim (DE)

(73) Assignee: Koeppern Entwicklungs GmbH, Hattingen (DE)

( * ) Notice: Subject to any disclaimer, the term of this patent is extended or adjusted under 35 U.S.C. 154(b) by 321 days.

(21) Appl. No.: 10/587,284

(22) PCT Filed: Jan. 5, 2005

(86) PCT No.: PCT/EP2005/000035

§ 371 (c)(1),
(2), (4) Date: Jul. 25, 2006

(87) PCT Pub. No.: WO2005/070549

PCT Pub. Date: Aug. 4, 2005

(65) Prior Publication Data

US 2007/0187538 A1 Aug. 16, 2007

(30) Foreign Application Priority Data

Jan. 27, 2004 (DE) ..... 20 2004 001 187 U

(51) Int. Cl.
*B02C 1/08* (2006.01)
*B02C 7/06* (2006.01)
*B21B 31/07* (2006.01)

(52) U.S. Cl. ..... 241/232; 241/285.3; 72/238; 100/168; 100/176

(58) Field of Classification Search ..... 241/285.2, 241/285.3, 232; 100/168, 176, 327, 155 R; 72/237–239
See application file for complete search history.

(56) References Cited

U.S. PATENT DOCUMENTS 3,899,965 A 8/1975 Koch et al.

(Continued)

FOREIGN PATENT DOCUMENTS

DE 2139547 A1 4/1973

(Continued)

OTHER PUBLICATIONS

FLSMIDTH: "HRP Hydraulic Roller Press" Internet Article, 'Online! Jul. 1995, XP002320963 Retrieved from the Internet: URL:http://www.flsmidth.com/flsmidth/english/contact/brochures+and+info/brochures/cement+grinding+gears+and+cement+silos/hrppress1.pdf Brochure "HRP Hydraulic Roller Press" der Fuller corporation von Jul. 1995.

*Primary Examiner*—Faye Francis
(74) *Attorney, Agent, or Firm*—Marshall, Gerstein & Borun LLP

(57) ABSTRACT

A roller press with a hinged frame having a frame substructure, a frame top wall and two head pieces arranged at the side, with at least one head piece, with a part of the frame top waling arranged on it, forming a side flap which is arranged on the frame substructure for opening out. In the hinged frame at least two rollers are placed, positioned adjacently, which, in a roller removal position of the hinged frame, can be removed from the hinged frame sideways via the removal opening formed by the opened-out side flap. The part of the frame top wall assigned to the side flap is arranged for swivelling relative to the head piece by means of an articulated joint arranged on the associated head piece, whereby the swivel axis of the articulated joint is arranged essentially parallel to the axes of the rollers.

10 Claims, 5 Drawing Sheets

U.S. PATENT DOCUMENTS 7,229,041 B2 * 6/2007 Cohen et al. ..... 241/285.3

FOREIGN PATENT DOCUMENTS

DE 3039743 A1 5/1982
DE 196 33 670 A1 2/1998
DE 100 18 271 A1 10/2001
EP 1 147 815 A2 10/2001

* cited by examiner

SINGLE-SIDED, DOUBLE HINGED FRAME FOR ROLLER PRESSES

CROSS-REFERENCE TO RELATED APPLICATION

This is the U.S. national stage under 35 U.S.C. § 371, of international application no. PCT/EP2005/000035, having an international filing date of Jan. 5, 2005, and claims priority to German application no. 20 2004 001 187.5 filed on Jan. 27, 2004.

FIELD OF THE DISCLOSURE

The disclosure relates to a roller press with a hinged frame consisting of a frame substructure, a frame top wall and two head pieces arranged at the side whereby at least one head piece with part of the frame top wall arranged on it forms a side flap, which is arranged so that it can be swivelled out on the frame substructure, and in the hinged frame at least two adjacently positioned rollers are located, which in a roller removal position of the hinged frame can be removed sideways from the hinged frame via the removal opening formed by the swivelled-out side flap.

BACKGROUND OF THE DISCLOSURE

Roller presses are used for briquetting, pulverising and compacting processes in processing plants. Granulates are charged between two rollers via a feed chute. The rollers press the granulate together, pulverise it or compact it. Roller presses thus modify the granulate condition of the initial material and, for example, briquettes are formed or fine dusts produced. In doing this the rollers are subject to substantial wear and must be serviced or replaced at certain intervals. Such replacement and service work and also the related inspections involve downtimes of the roller press and of the associated complete processing plant.

With regard to the availability of a processing plant there is the task of minimizing the downtimes for roller presses, because during briquetting, pulverising and compacting the downtimes of the equipment are essentially determined by the replacement of worn tools, i.e. roller linings, segments, etc. For the tool replacement the rollers, on which the tools are located, must be removed from the machine. For processes in which a roller press is operated in a key position, high outage costs may then arise due to the downtimes during roller changes. Particularly during the operation of a number of machines in a process, for example during hot briquetting, service work accounts for a large amount of time.

Various opening mechanisms are known for carrying out servicing or roller changes on a roller press. In this respect both hinged frames are used which permit a fast change of roller and also frames which must be partially dismantled for a change of roller. When selecting a suitable machine frame for a roller press, various aspects must be considered, from the use of the roller press to the siting position.

With the selection of a hinged frame which permits the change of roller only on one side of the machine only a small area is needed for siting the equipment, because in this case only one side flap must be opened up. Here, apart from a head piece of the frame, this side flap may also include a part of the frame top wall which is permanently joined to the head piece and is used as an end stop when withdrawing the rollers. However, in order to be able to change or service the rear roller of the pair of rollers, with this sort of single-sided hinged frame the front roller must also in each case be removed, which is obstructive in the case of the exclusive change or inspection of the rear roller. However, an advantage is that with a single-sided hinged frame both rollers can be lifted by an overhead crane and be transported without the feed chute of the roller press having to be dismantled (refer to FIG. 4).

With a hinged frame which permits a change of rollers from both sides of the machine, a larger area is needed for the equipment, because both side regions, i.e. head pieces, of the frame must be opened up. This type of double-sided hinged frame facilitates the convenient removal of both rollers of the pair of rollers independently. Also the material feed walls and the tongues of the metering hopper do not need to be dismantled. However, for lifting the rollers an overhead crane is needed on both sides of the roller press, because the metering hopper and the bunker over the roller press prevent access of a single overhead crane to both sides of the hinged frame (refer to FIG. 5).

Roller frames, which cannot be swivelled out, but rather in which the upper region of the machine must be dismantled, exhibit significantly increased assembly effort compared to hinged frames. For changing the rollers the metering hopper unit must be taken down and removed via complicated moving mechanisms. Apart from the intensity of the work, the time required with such frames for changing or servicing the rollers is significantly increased compared to hinged frames.

SUMMARY OF THE DISCLOSURE

The object of the disclosure is therefore to provide a frame for roller presses which avoids the disadvantages of previous hinged frames known from the state of the art and to facilitate shorter downtimes during a change of rollers.

This object is solved according to the disclosure in that the part of the frame top wall assigned to the side flap is arranged for swivelling relative to the head piece by means of an articulated joint positioned on the associated head piece.

This embodiment of the roller press according to the disclosure facilitates a simple and convenient removal or servicing of the rollers through an enlarged removal opening of the hinged frame. The use of this hinged frame thus realizes fast roller dismantling with simple logistics and minimum effort in dismantling on the overall equipment. These roller presses according to the disclosure are particularly advantageous for plants in which a number of machines must be regularly serviced or rollers regenerated and in which the downtimes accumulate.

Advantageously the opened-up head piece and the swivelled out part of the frame top wall of the side flap can form an extension of the frame substructure and be formed as load-bearing sections for accommodating the rollers. In this way sideways removal of both rollers onto the preferably level extension and simple removal of the rollers, e.g. by means of an overhead crane, are facilitated. Thus, the rear roller of the roller pair can also be taken down from the carrier sections and optionally replaced, while the front roller remains on the carrier sections. Here, the load-bearing carrier sections protrude far beyond the basic area of the closed hinged frame of the roller press. Since this however is only the case when the equipment is stopped, a possible protrusion of the carrier sections into a pathway and any general hazard can be regarded as not critical.

A modification provides for a roller being formed as a floating roller and the floating roller is arranged on the side of the side flap in the hinged frame. Since the wear on the floating roller is statistically greater than the wear on the fixed roller, this arrangement facilitates overall the least possible effort in dismantling/assembly and thus the shortest associated downtimes.

A further embodiment provides for a roller being formed as a floating roller and the floating roller is arranged opposite the side of the side flap in the hinged frame. With such an embodiment the pressing device required for pressing the floating roller in the direction of the fixed roller does not have to be taken out of the hinged frame when replacing the rollers and can remain in the hinged frame even when replacing or servicing the rear roller.

Practicably, the swivelling part of the frame top wall can extend over between 25% and 50% of the frame topwall. This facilitates a large removal opening for only a slight protrusion of the carrier sections with respect to the roller press and despite this, adequate access is obtained for removing the rollers. Here, the swivelling part of the frame top wall can additionally be enlarged by the length of the pressing device.

To obtain a well balanced loading capability of the carrier sections with good accessibility, the length of the swivelling section of the frame top wall can correspond to at least the height of the head pieces arranged at the side.

A preferred variant provides for a feed device to be arranged on the frame top wall and the swivelling part of the frame top wall to extend up to the feed device. The configuration of the complete region of the frame top wall between the opened-out head piece and the feed device, normally a funnel, as a swivelling part of the frame top wall facilitates the maximum removal opening.

A favorable formation of the roller press according to the disclosure can provide for means to be used for moving the rollers to the side. In this way the sideways exit or withdrawal of the rollers from the covered region of the hinged frame onto the opened-out head piece or onto the swivelled-out part of the frame top wall is facilitated.

To facilitate the simple sideways withdrawal and insertion of the rollers, the sideward travel of the rollers can extend up to the opened-out side flap or the swivelled-out part of the frame topwall.

BRIEF DESCRIPTION OF THE DRAWINGS

In the following an embodiment of the disclosure is explained in more detail based on a drawing. The following are shown.

DETAILED DESCRIPTION OF THE DISCLOSURE

Figure 1:
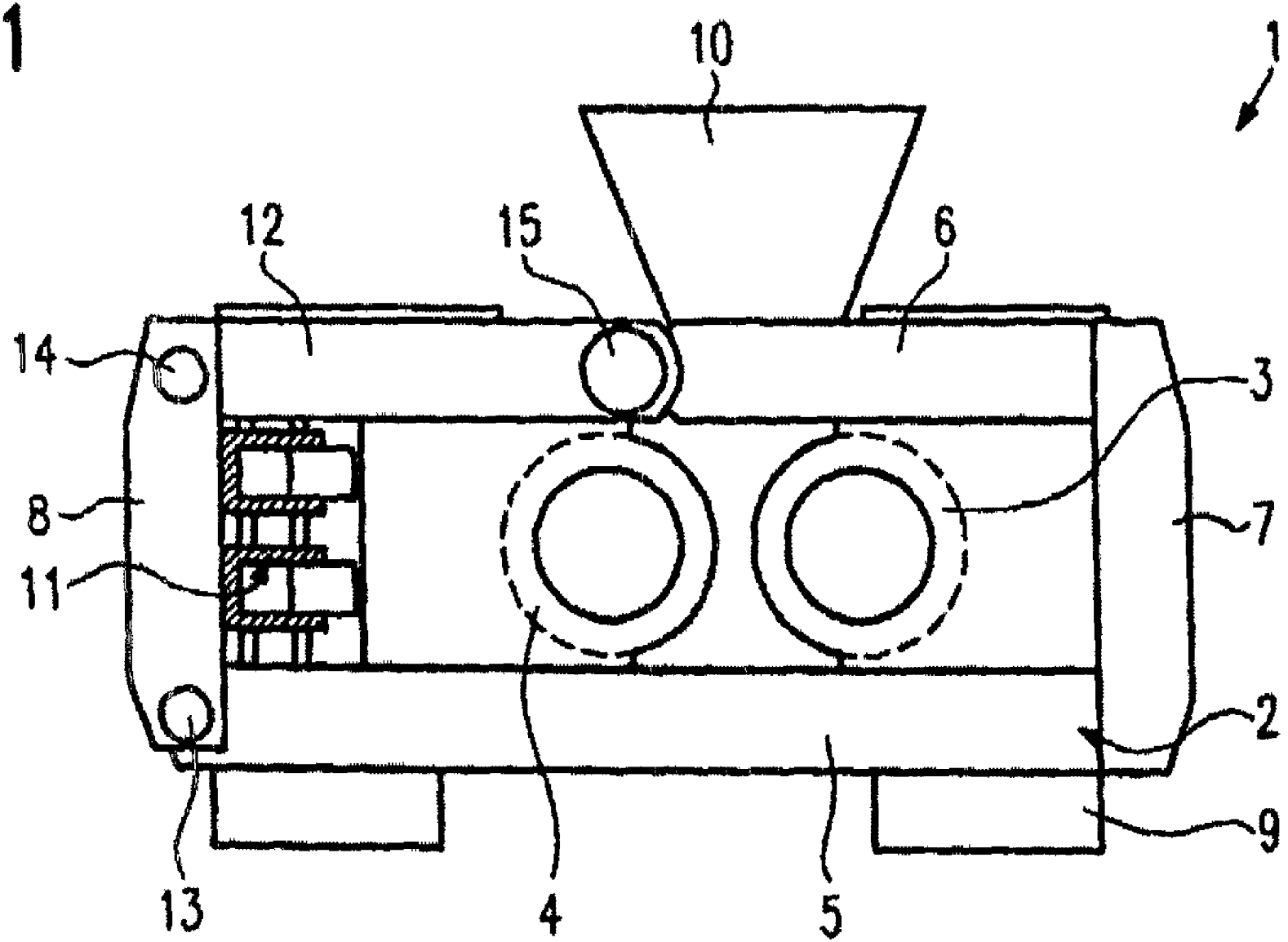
FIG. 1 a schematic illustration of a roller press according to the disclosure with closed hinged frame, FIG. 2 a schematic illustration of the roller press from FIG. 1 with open hinged frame, whereby only the side head piece is opened-out, FIG. 3 a schematic illustration of the roller press according to FIGS. 1 and 2, in which the hinged side head piece and the swivelling part of the frame top wall are opened out and the rollers are pulled sideways onto the opened-out frame parts, FIG. 4 a schematic illustration of a roller press according to the state of the art with a single-sided hinged frame which can be opened out, FIG. 5 a schematic illustration of a roller press according to the state of the art with a double-sided hinged frame which can be opened out.

FIG. 1 shows a schematic illustration of a roller press 1 in a side plan view. In this figure and in all the following figures, the same elements are given the same reference symbols. The roller press 1 comprises a hinged frame 2 and two rollers 3 and 4. The rollers 3 and 4 are arranged inside the hinged frame 2 during operation. The hinged frame 2 consists of a frame substructure 5, a frame top wall 6 and two head pieces 7 and 8 arranged at the side, whereby one head piece 7 joins the frame substructure 5 and the frame top wall 6 permanently together, whereas the second head piece is formed as a side flap arranged on the frame substructure 5 and which can be opened out. The frame substructure 5 comprises positioning sections 9 protruding downwards for positioning the roller press 1 on a surrounding area. A funnel-shaped feed device 10 is arranged above the rollers 3 and 4 and above the frame top wall 6 of the hinged frame 2. The feed device 10 has two openings, whereby the granulate to be processed is charged into the upper opening, whereas it enters a gap between the rollers 3 and 4 through the lower opening.

During operation one roller, here roller 3, is arranged fixed in the hinged frame 2, whereas the second roller (roller 4) is movable and is pressed in the direction of the fixed roller by a pressing device 11. A movable part 12 of the frame top wall 6 joined to the head piece 8 extends between the head piece 8 of the side flap and the feed device 10, so that the side flap consists of the head piece 8 and the movable part 12. The head piece 8 of the side flap is fastened to the frame substructure 5 by means of an articulated joint 13 and the movable part 12 of the frame top wall 6 is in turn fastened by means of a second articulated joint 14 to the head piece 8 of the side flap. In this respect the joints 13 and 14 are arranged at opposite ends of the head piece 8. The movable part 12 of the frame top wall 6 is fastened to the immovable section of the frame top wall 6 in the region of the feed device 10 by means of a releasable fastening device 15. The frame substructure 5, the fixed head piece 7 and the immovable section of the frame top wall 6 together form a stable section of the hinged frame 2 in the form of an open C section. In this regard the fixed section of the frame top wall 6 carries the feed device 10 and other equipment parts required for feeding the granulate, for example, material feed system, bunker, etc.

Figure 2:
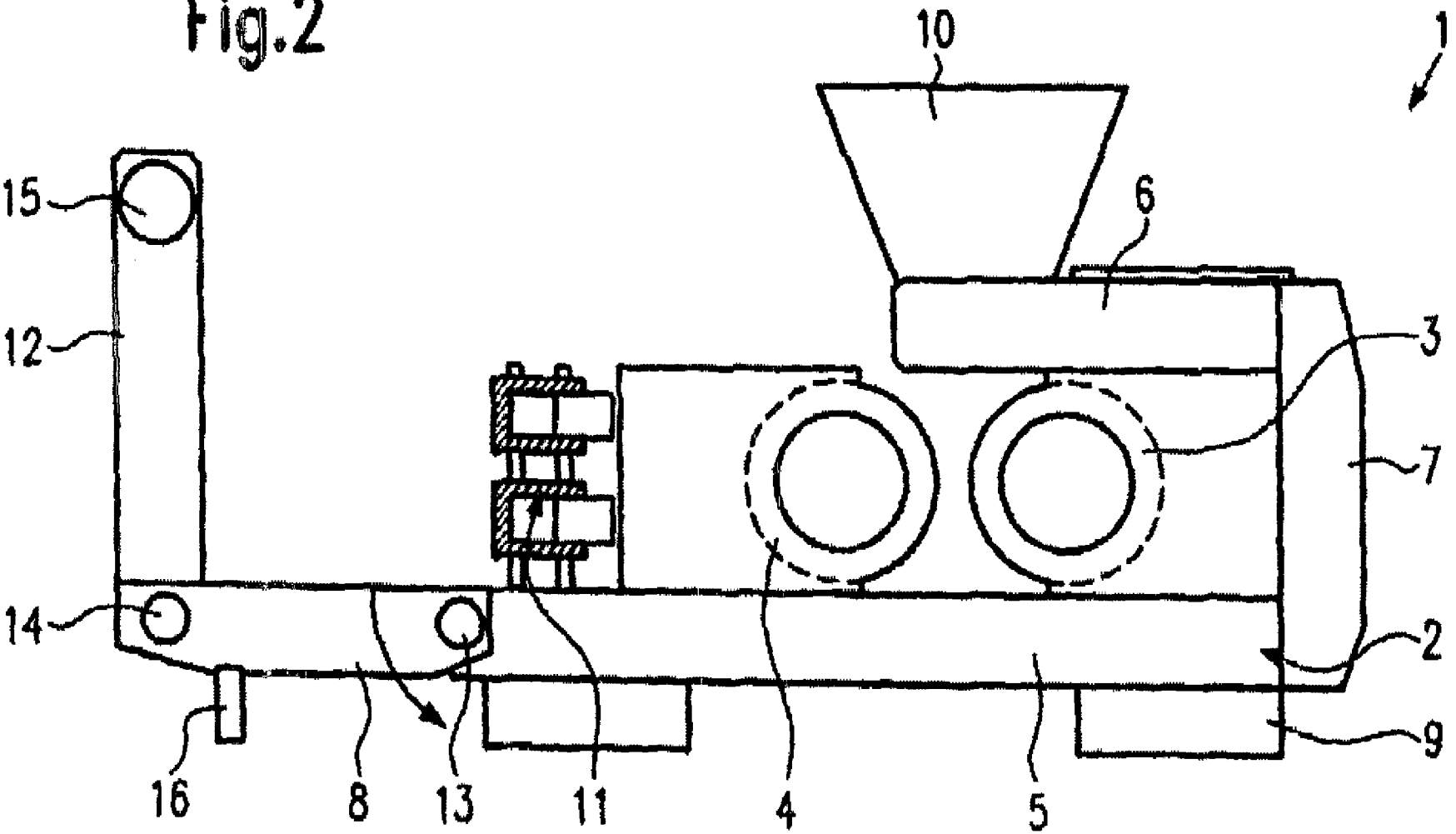

FIG. 2 shows the roller press 1 according to the disclosure with the hinged frame 2 from FIG. 1 in a partially opened-out state. In this connection the side flap has been swivelled about the articulated joint 13 in the direction of the drawn-in arrow. The head piece 8 of the side flap is supported in this swivelled-out position with respect to the surrounding area by a support section 16 in order to form a plane for the sideward movement of the rollers 3 and 4 together with the frame substructure 5.

Figure 3:
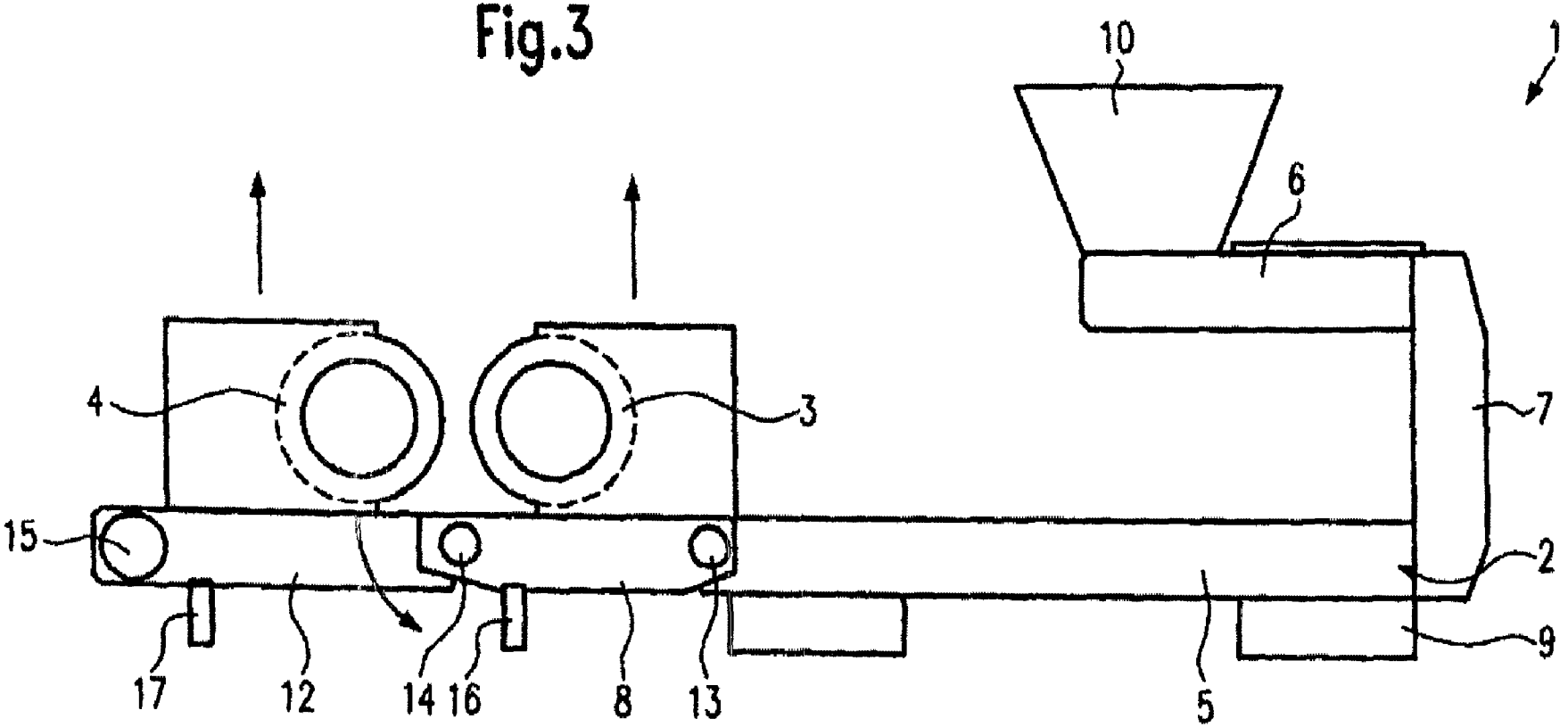

In FIG. 3 the hinged frame 2 is shown in a fully swivelled-out position. To achieve this, the movable part 12 of the frame top wall 6 has been swivelled in the direction of the arrow with the head piece 8 opened out about the articulated joint 14. The movable part 12 is supported similar to the head piece 8 of the side flap on the surrounding area by a further supporting section 17 and together with the head piece 8 and the frame substructure 5 forms a common level for the sideways movement of the rollers 3 and 4. In the assembled state shown in FIG. 3, the rollers 3 and 4 are positioned on the movable part 12 and the head piece 8 of the side flap.

The functioning principle of the hinged frame 2 is explained in more detail in the following:

To remove the rollers 3 and 4 from the hinged frame 2 for a change of the press rollers or necessary service work, the side flap of the head piece 8 and the part 12 of the frame top wall 6 joined to it can be opened, for which the locking device 15 must first be released. After releasing the locking device 15, the head piece 8 is swivelled about the articulated joint 13 and the movable part 12 is swivelled about the articulated joint 14 so that a large removal opening is formed. The head piece 8 and the movable part 12 of the frame top wall 6 are supported by the support sections 16 and 17 on a siting area and together with the frame substructure 5 form a level for the sideways movement of the rollers 3 and 4. To obtain access to the rollers 3 and 4, first the pressing device 11 must be moved or removed, for example lifted from the removal opening by an overhead crane. Then, depending on the dismantling or servicing requirements, just the floating roller 4 or also the fixed roller 3 is pulled from its operating position in the hinged frame 2 sideways into the region of the removal opening by means of a sideways pulling device or a hydraulic moving device. After the sideways movement of the rollers 3 and 4 they are, positioned on the movable part 12 of the frame top waling and the head piece 8 of the side flap, easily accessible and can be removed from the hinged frame by means of an overhead crane or other lifting equipment, as indicated in FIG. 3 by the arrows pointing upwards.

On opening out the head piece 8 and the movable part 12 of the side flap, these parts move in a two dimensional manner each about an axis through the articulated joints 13 and 14 so that the joints 13 and 14 act as hinges. In this regard the axes through the joints 13 and 14 run essentially parallel to one another.

Figure 4:
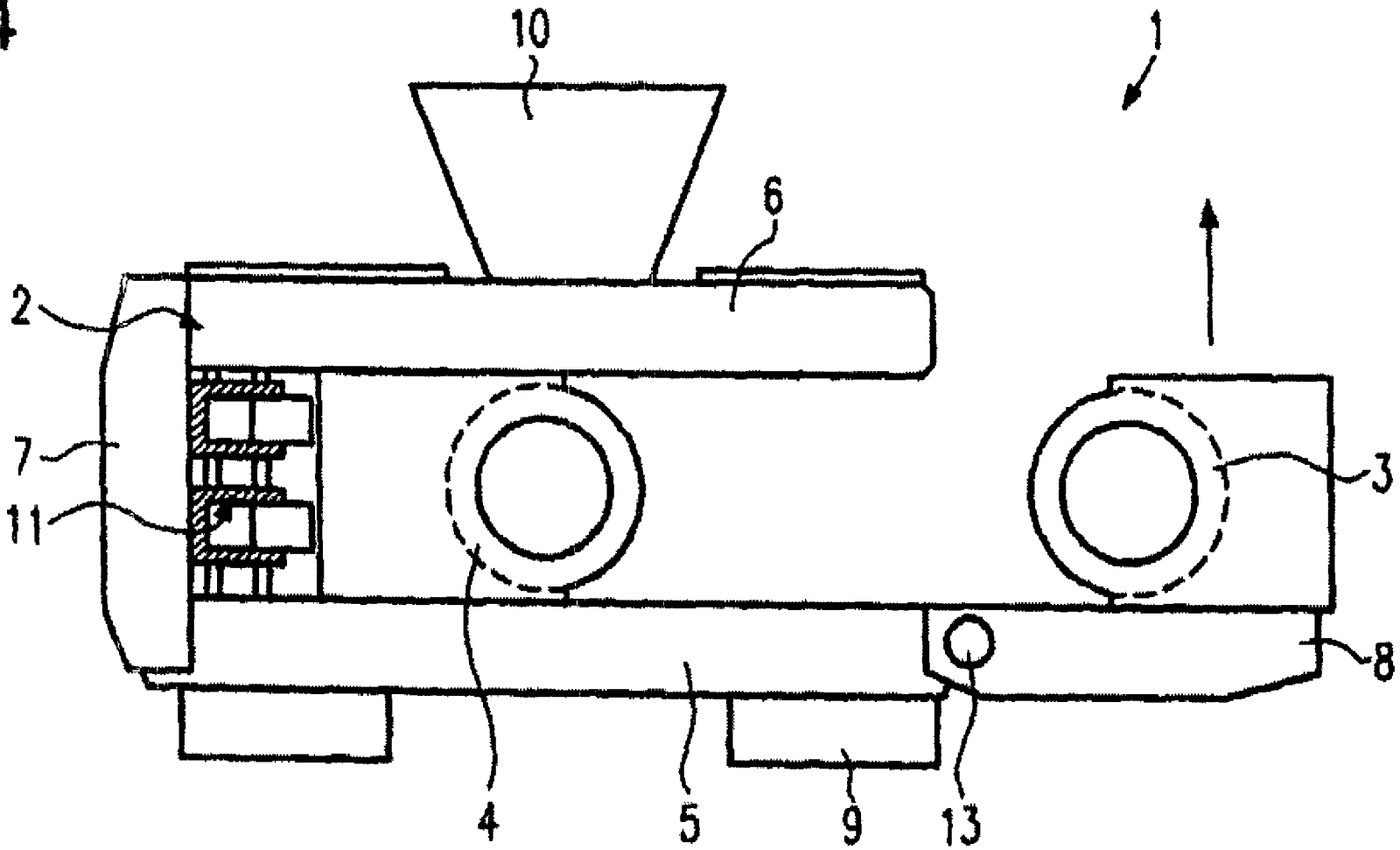
Prior Art Fig.4

FIG. 4 shows a roller press 1 known in the state of the art with a single-sided, one-part flap mechanism. For clarification only the features differing from the above described embodiment are described, whereby the same reference symbols are used for the same elements. Also with these conventional roller presses 1 the hinged frame 2 comprises a frame substructure 5, a frame top wall 6 and a side head piece 7 which together form an immovable C profile, and a side flap from a second head piece 8 which can be opened out. Due to the removal opening of the hinged frame 2 with the opened-out side flap, the rollers 3 and 4 can be removed individually from the hinged frame. If only the front roller (here roller 3) has to be replaced or serviced, this is possible in a simple manner, because the front roller can be pulled out of the hinged frame 2 onto the side flap, where it can be serviced or lifted off for replacement. However, with the servicing or replacement of the rear roller, in this case the floating roller (roller 4) which is more susceptible to wear, first the front roller must be pulled out of the hinged frame 2 and lifted from the side flap. Only then can the rear roller be pulled out into the region of the side flap for servicing or replacement.

Figure 5:
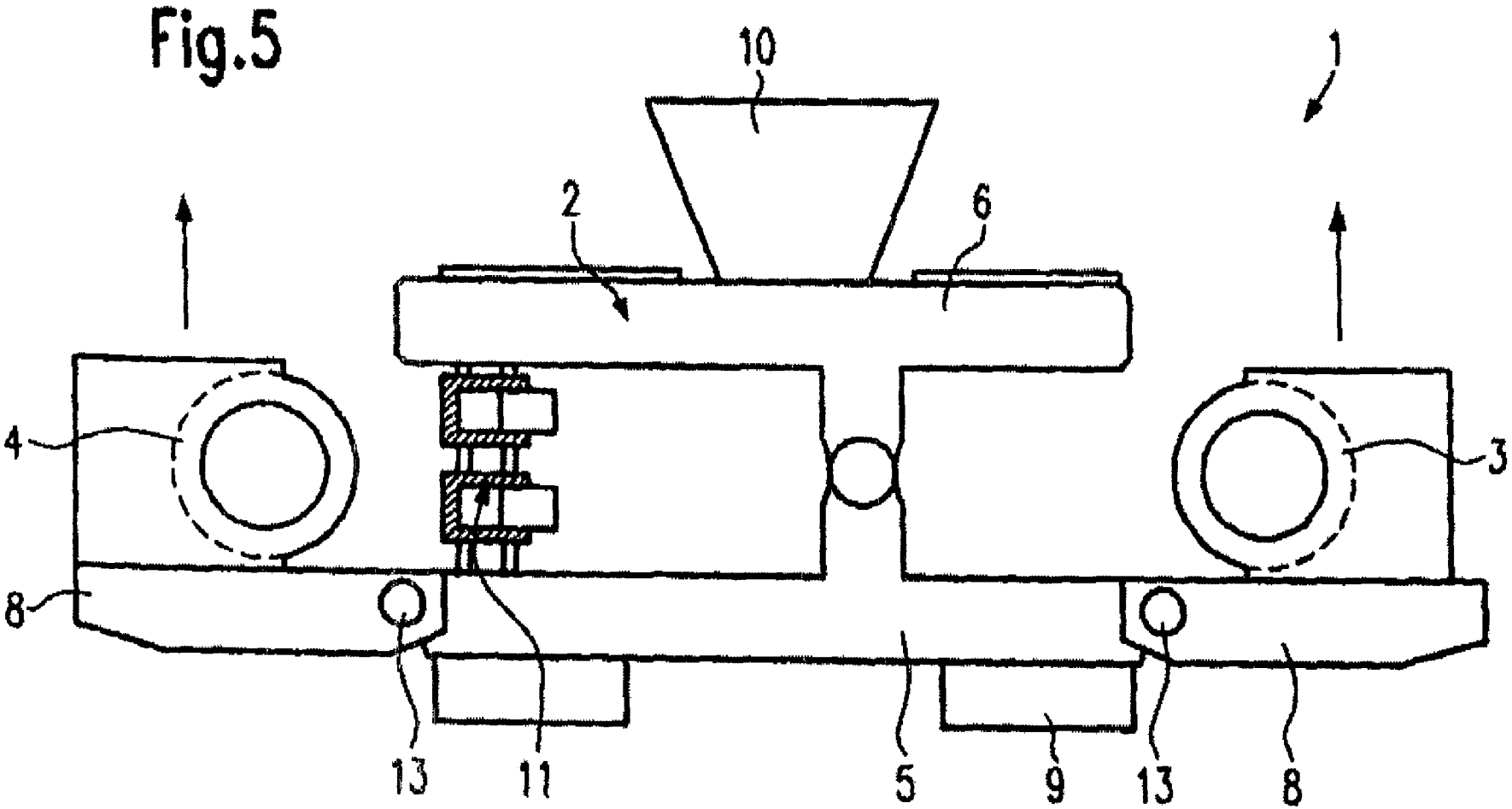
Fig.5 Prior Art

With the roller press illustrated in FIG. 5 with a hinged frame 2 which can be opened on both sides, the rollers 3 and 4 can be pulled out independently of one another in each case to one side of the hinged frame 2 onto in each case an opened-out side flap, comprising the head pieces 8, to facilitate servicing or a replacement in that position. This, however, requires access on both sides of the roller press 1 and equipment for lifting the rollers 3 and 4 on both sides.

We claim:

1. Roller press (1) comprising a hinged frame (2) having a frame substructure (5), a frame top wall (6) and two head pieces (7, 8) arranged at the side, at least one head piece (8) with part (12) of the frame top wall arranged thereon forming a side flap, the side flap arranged so that it can be opened out on the frame substructure (5), at least two adjacently positioned rollers (3, 4) located in the hinged frame, which in a roller removal position of the hinged frame (2) can be removed from the hinged frame (2) sideways via the removal opening formed by the opened-out side flap, and the part (12) of the frame top wall assigned to the side flap is arranged for swivelling relative to the head piece (8) by means of an articulated joint (14) arranged on the associated head piece (8), wherein the swivel axis of the articulated joint is arranged essentially parallel to axes of the rollers (3, 4).

2. Roller press (1) according to claim 1, wherein the opened-out head piece (8) and the swivelled-out part (12) of the frame top wall of the side flap form a level extension of the frame substructure (5) and are formed as load-bearing sections for accommodating the rollers (3, 4).

3. Roller press (1) according to claim 1, wherein a roller (3, 4) is formed as a floating roller and the floating roller is arranged on the side of the side flap in the hinged frame (2).

4. Roller press (1) according to claim 1, wherein one of the rollers (3, 4) is formed as a floating roller and the floating roller is arranged opposite the side of the side flap in the hinged frame (2).

5. Roller press (1) according to claim 1, wherein the swivelling part (12) of the frame top wall extends over between approximately 25% and 60% of the frame top wall (6).

6. Roller press (1) according to claim 1, wherein the length of the swivelling part (12) of the frame top wall corresponds to at least the height of the head pieces (7, 8) arranged at the side.

7. Roller press (1) according to claim 1, wherein a feed device is arranged on the frame top wall (6) and the swivelling part (12) of the frame top wall extends up to the feed device.

8. Roller press (1) according to claim 1, and means for the sideways movement of the rollers (3, 4).

9. Roller press (1) according to claim 8, wherein the path of the sideways movement of the rollers (3, 4) extends up to one of the opened-out side flap or up to the swivelled-out part (12) of the frame top wall.

10. Roller press (1) according to claim 1, wherein the rollers (3, 4) are supported by axles thereof in bearing housings, wherein the bearing housings extend between the frame substructure (5) and the frame top wall (6), and the rollers (3, 4) can be removed by means of the bearing housings which are movable by sliding on the frame substructure (5) and the removal opening.

* * * * *